US008096727B2

(12) United States Patent
Parenti et al.

(10) Patent No.: US 8,096,727 B2
(45) Date of Patent: Jan. 17, 2012

(54) RETRACTABLE POST SYSTEM

(76) Inventors: Chris Parenti, Novi, MI (US); Abel Gutierrez, Taylor, MI (US)

( * ) Notice: Subject to any disclaimer, the term of this patent is extended or adjusted under 35 U.S.C. 154(b) by 763 days.

(21) Appl. No.: 11/753,955

(22) Filed: May 25, 2007

(65) Prior Publication Data

US 2008/0290333 A1 Nov. 27, 2008

(51) Int. Cl.
*E01F 13/04* (2006.01)

(52) U.S. Cl. ..... 404/6; 49/33; 49/49; 49/131

(58) Field of Classification Search ..... 49/33, 49, 49/131; 404/6; 403/109.2
See application file for complete search history.

(56) References Cited

U.S. PATENT DOCUMENTS 918,579 A * 4/1909 Murch ..... 248/353
3,660,935 A * 5/1972 Boots ..... 49/35
3,724,885 A * 4/1973 Becker ..... 403/104
4,576,508 A * 3/1986 Dickinson ..... 404/6
4,715,742 A * 12/1987 Dickinson ..... 404/6
4,919,563 A * 4/1990 Stice ..... 404/6
5,054,237 A * 10/1991 Kapala et al. ..... 49/35
5,474,017 A * 12/1995 Mohebbi et al. ..... 116/209
5,803,426 A * 9/1998 Hart ..... 248/523
6,095,081 A * 8/2000 Gochenour ..... 116/209
6,289,633 B1 * 9/2001 Lowe ..... 49/49
6,821,050 B1 * 11/2004 Maldonado ..... 404/6
6,955,495 B1 * 10/2005 Datta et al. ..... 404/10
2007/0048083 A1 * 3/2007 Burns et al. ..... 404/6

* cited by examiner

*Primary Examiner* — Gary S Hartmann
(74) *Attorney, Agent, or Firm* — Gifford, Krass, Sprinkle, Anderson & Citkowski, P.C.

(57) ABSTRACT

A temporary barricade in the form of a retractable post system. In one configuration, the post is lowered into the ground, such that the top of the post is flush with the ground surface, leaving an unobtrusive configuration that one can walk over, drive over, and so forth. In another configuration, however, the post can be pulled up from the ground, and with a moderate rotational twisting motion, locked into vertical position, thereby providing a strong barrier to traffic and other situations.

6 Claims, 2 Drawing Sheets

RETRACTABLE POST SYSTEM

FIELD OF THE INVENTION

This invention relates generally to posts or "bollards," and, more particularly, to a retractable post system that can be extended vertically from, and lowered into a floor surface.

BACKGROUND OF THE INVENTION

There are many situations where temporary vertical posts or bollards are desirable. For example, in traffic situations, it may be advantageous to have barriers present during certain times or events, but removed during other circumstances. While it is always possible to position and remove temporary barriers such as hinged panels, and the like, these are heavy, often unsightly, and can create maintenance and/or storage problems.

SUMMARY OF THE INVENTION

This invention improves upon existing temporary barricades by providing a retractable post system. In one configuration, the post is lowered into the ground, such that the top of the post is flush with the ground surface, leaving an unobtrusive configuration that one can walk over, drive over, and so forth. In another configuration, however, the post can be pulled up from the ground, and with a moderate rotational twisting motion, locked into vertical position, thereby providing a strong barrier to traffic and other situations.

DETAILED DESCRIPTION OF THE INVENTION

Figure 1:
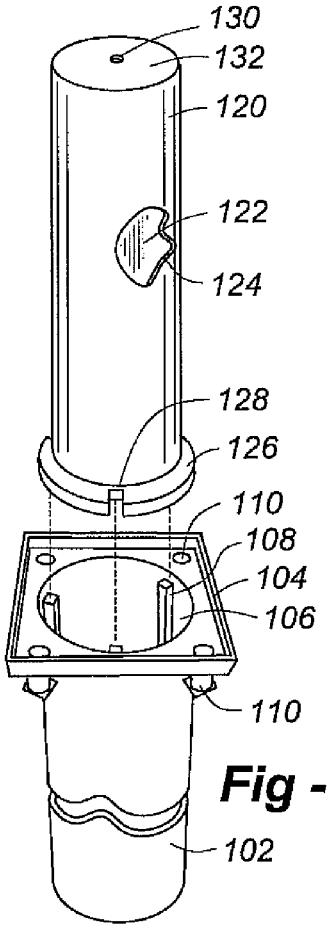
FIG. 1 is an exploded view drawing showing a retractable barrier according to the invention before the post is installed into a receiving sleeve.

FIG. 1 is an exploded view drawing illustrating certain aspects of the preferred embodiment. The system includes a below-ground sleeve 102 including an upper flanged portion 104 with threaded holes 110. The sleeve and flange are preferably constructed from metal, such as welded steel.

The inner bore 106 of the sleeve 102 includes a plurality of elongate, vertical side ribs 108. Three such ribs are used in the preferred embodiment, though more or fewer are possible. The ribs are also preferably made of steel, tack welded to the inner wall of the sleeve 102.

A post 120 is lowered into the below-ground sleeve in a manner described in more detail below. The post 120 has a lower flange 126 with a plurality of cut-outs 128 that match the cross-sectional geometry of the ribs 108. The post 120 further includes an upper, preferably flat surface 132 having a connector 130 to receive a handle. The handle preferably screws into a threaded hole, though other attachment mechanisms are possible. A portion of the side wall of the post 120 is removed, to show that, in addition to a solid metal or plastic post, a metal tube 122 may be used with an outer plastic covering 124, thereby reducing maintenance, enhancing appearance, and facilitating different, bright colors without painting, for example.

Figure 2:
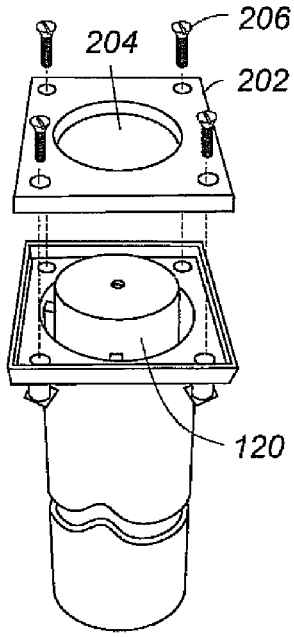
FIG. 2 shows the post installed, with a retaining plate being screwed into position.

FIG. 2 shows the post 120 lowered into the sleeve 102, and with the attachment of a retaining plate 202 into the flanged upper portion of the receiving sleeve. A plurality of fasteners 206 cooperate with the threaded hole 110, to secure the flange in position. Although slotted bolts are shown, other types of fasteners may be used. For example, fasteners with hex heads or proprietary geometries to minimize tampering are other possibilities. The retaining plate 202 may also be welded in place, if a more permanent installation is desired.

Figure 4:
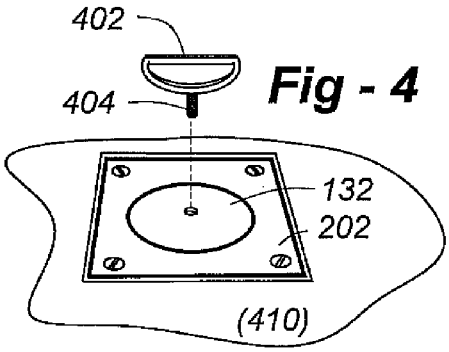
FIG. 4 is a drawing that shows a handle being applied to a connector on the post.
Figure 3:
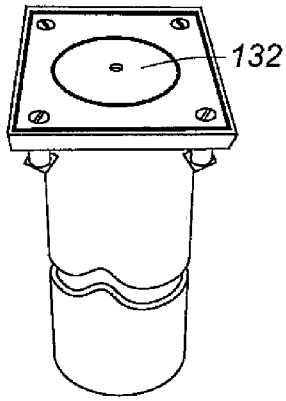
FIG. 3 shows the retaining plate in position, with the top surface of the post and top surface of the retaining plate being flush with a surrounding ground surface.
Figure 6:
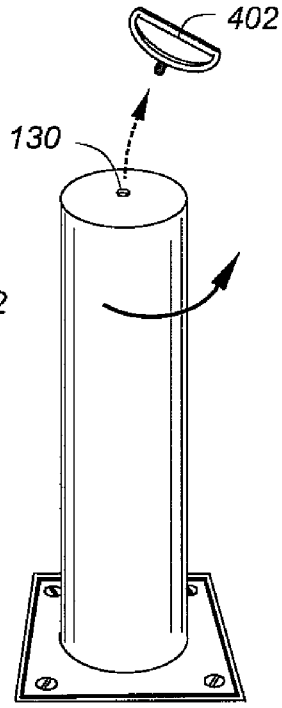
FIG. 6 shows the post being locked into a vertical position through a twisting motion, and the handle removed.
Figure 7:
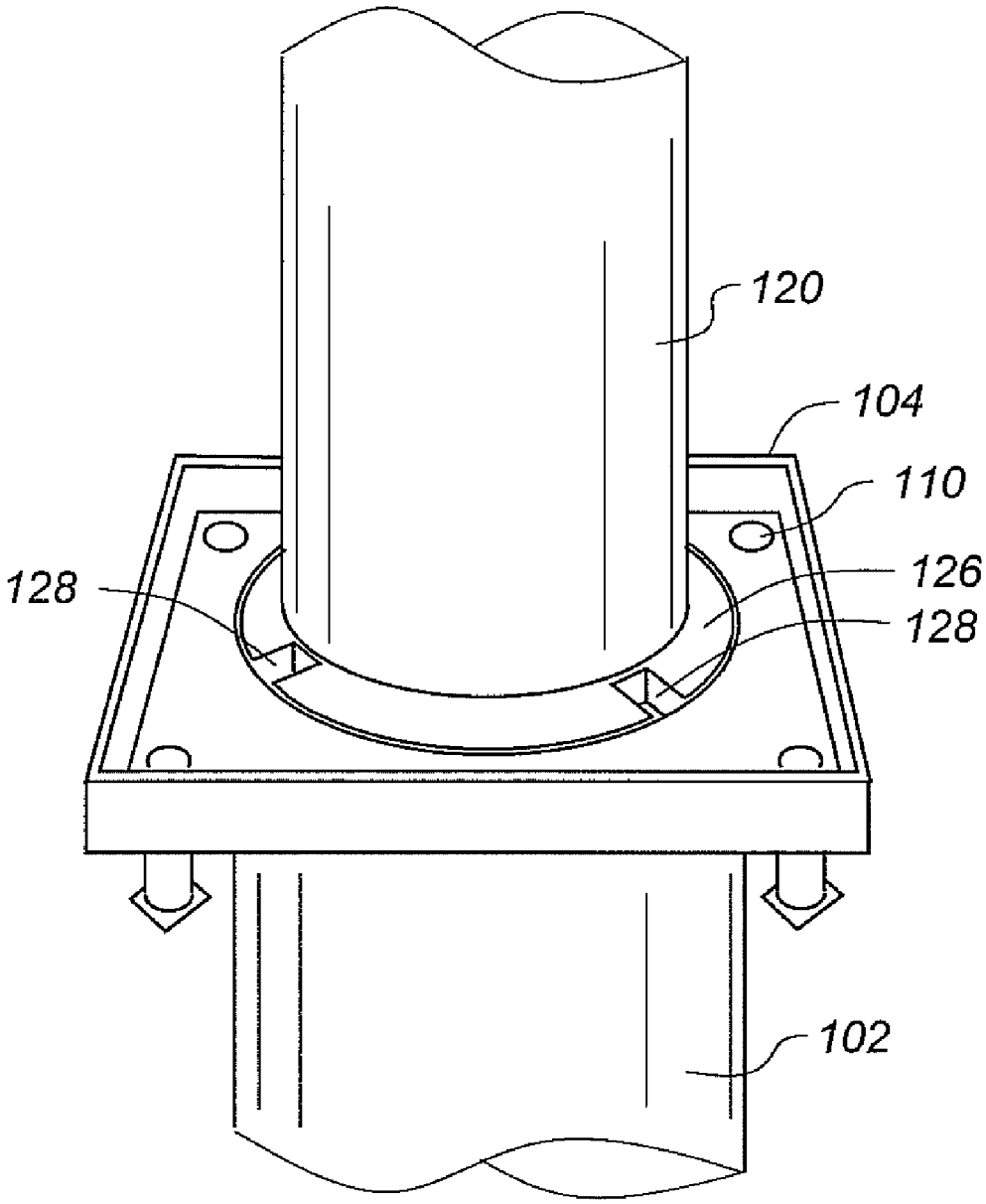
FIG. 7 is a detail drawing of the configuration of FIG. 6 with the retaining plate removed.

The retaining plate 202 includes a central aperture 204 having an inner diameter that is slightly larger than the outer diameter of the post 120. The height of the post 120 is such that, when received by the sleeve 102, and with the retaining plate 202 in position, the top surface 132 of the post is substantially flush with the exposed surface of the retaining plate, and the surrounding ground surface, as shown in FIGS. 3 and 4. As shown in FIGS. 1 and 2, note that the upper extent of the ribs 108 stops short of the bottom of the flanged portion by a distance slightly greater than the thickness of the flange 128 on the post 120. This allows the post to be pulled upwardly until the flange 126 is stopped by the retaining plate 202, at which time the post may be turned by a moderate degree, and locked in position, as shown in FIG. 6. FIG. 7 is a detail drawing of the configuration of FIG. 6 with the retaining plate removed.

Figure 5:
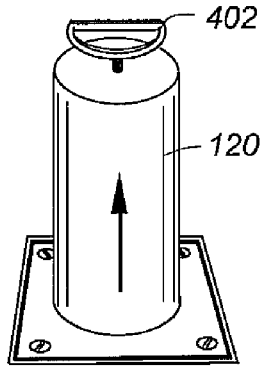
FIG. 5 shows the post being lifted out of the ground with the handle.

To accomplish this extension process, some type of pull mechanism is attached to the exposed portion of the post 120. In the preferred embodiment, a handle 402 having a threaded portion 404 is screwed into a threaded receptacle 130 on the top of the post, allowing it to be pulled upwardly, as shown in FIG. 5. When the post is pulled up as far as possible, it is rotated a moderate amount, such that the cut-outs 128 are no longer in alignment with the ribs 108, but rather, the bottom of the flange 126 now rests on the top surfaces of the ribs 108, resulting in a vertically maintained rigid barrier system, that may be retracted by a process opposite to that just described. That is, by reattaching the handle, rotating the post until the cut-outs 128 are in alignment with the ribs 108, the post may be lowered into the ground, until the top of the post is flush with the retaining plate and surrounding ground surface, at which time the handle may again be removed.

We claim:

1. A retractable barrier system, comprising:

a below-ground sleeve having an inner surface;

a post received by the sleeve such that the top surface of the post is flush with the ground surface in a retracted position;

a structure, whereby the post may be pulled up from the sleeve, and locked into an upright, extended position through a rotational movement;

a longitudinal rib on the inner surface of the sleeve, the rib having a cross-sectional geometry and a top surface; and wherein the post includes a bottom flange with a cut-out conforming to the cross-sectional geometry of the rib, such that when the post is pulled up with the flange beyond the upper surface of the rib, the post may be rotated such that the flange rests on the upper surface of the rib, maintaining the post in a vertical, upright position.

2. The system of claim 1, wherein the post includes an attachment point on its upper top surface to assist with retraction and extension.

3. The system of claim 1 wherein the post is constructed from a metal tube covered with a plastic sleeve.

4. The system of claim 1 wherein the sleeve includes an upper flanged portion and a retaining plate having an aperture with a diameter slightly larger than the outer diameter of the post.

5. The system of claim 1 wherein the post is generally cylindrical in shape, with a substantially flat top.

6. The system of claim 1 wherein the post has a diameter in the range of 3-8 inches.

* * * * *